US008740652B2

(12) United States Patent
Hsueh

(10) Patent No.: US 8,740,652 B2
(45) Date of Patent: Jun. 3, 2014

(54) RECEPTACLE CONNECTOR AND ASSEMBLING METHOD THEREOF

(71) Applicant: Ant Precision Industry Co., Ltd., Taipei (TW)

(72) Inventor: Chih-Yu Hsueh, Taipei (TW)

(73) Assignee: Ant Precision Industry Co., Ltd., Taipei (TW)

( * ) Notice: Subject to any disclaimer, the term of this patent is extended or adjusted under 35 U.S.C. 154(b) by 22 days.

(21) Appl. No.: 13/667,058

(22) Filed: Nov. 2, 2012

(65) Prior Publication Data

US 2013/0178106 A1 Jul. 11, 2013

Related U.S. Application Data

(60) Provisional application No. 61/583,211, filed on Jan. 5, 2012.

(51) Int. Cl.
*H01R 33/00* (2006.01)

(52) U.S. Cl.
USPC ..... 439/660; 439/607.41

(58) Field of Classification Search
USPC ..... 439/541.5, 607.23, 607.41, 660, 941
See application file for complete search history.

(56) References Cited

U.S. PATENT DOCUMENTS

| | | | | |
|---|---|---|---|---|
| 7,625,243 | B2 | 12/2009 | Chen et al. | |
| 7,896,559 | B2 * | 3/2011 | Yi et al. | 385/75 |
| 7,946,893 | B2 * | 5/2011 | Chen et al. | 439/660 |
| 8,444,423 | B2 * | 5/2013 | Nguyen et al. | 439/76.1 |

FOREIGN PATENT DOCUMENTS

| | | | |
|---|---|---|---|
| TW | M391203 | U1 | 10/2010 |
| TW | M394623 | U1 | 12/2010 |
| TW | M406842 | U1 | 7/2011 |

* cited by examiner

*Primary Examiner* — Khiem Nguyen
(74) *Attorney, Agent, or Firm* — Li & Cai Intellectual Property (USA) Office

(57) ABSTRACT

A receptacle connector including a ladder-like insulative body, a plurality of first conductive contacts and a plurality of second conductive contacts. The first conductive contacts and the second conductive contacts are exposed toward the same side over one end of the insulative body. The first conductive contacts and the second conductive contacts can be soldered to a transmission wire for data transmission. The instant disclosure further comprises an assembling method of a receptacle connector.

20 Claims, 7 Drawing Sheets

RECEPTACLE CONNECTOR AND ASSEMBLING METHOD THEREOF

BACKGROUND OF THE INSTANT DISCLOSURE

1. Field of the Instant Disclosure

The instant disclosure relates to an electrical connector and an assembling method thereof; in particular, to a receptacle connector and an assembling method thereof.

2. Description of Related Art

Receptacle connectors are commonly used for data transmission in recent days, where one of the most popular receptacle connectors is the USB 3.0 connector. Compared to the prior versions such as the USB 1.0, 1.1, and 2.0, the USB 3.0 has a much faster data transmitting speed. Furthermore, the USB 3.0 has a lower power consumption rate and is compatible to the prior versions such as the USB 1.1 and 2.0. In terms of structural design, a standard USB 3.0 includes a plurality of differential signal contacts, a power contact, and a pair of ground contacts. According to the Taiwan patent, No. TWM391203, a wire-soldered receptacle connector is disclosed, where the receptacle connector has a plurality of first soldering cups and a plurality of second soldering cups. Furthermore, the first soldering cups and the second soldering cups are exposed by facing the opposite directions. After the transmission wires are soldered to the first soldering cups, the receptacle connector has to be flipped over for the transmission wires to be soldered to the second soldering cups. In addition, the signal wire, the power wire and the ground wire which are soldered to the differential signal contact, power contact, and the ground contact are bundled together.

SUMMARY OF THE INSTANT DISCLOSURE

The object of the instant disclosure is to provide a receptacle connector and an assembling method thereof, where the receptacle connector can be soldered more easily to a transmission wire.

The receptacle connector comprises an insulative body, a plurality of first conductive contacts, and a plurality of second conductive contacts. The insulative body has a substantially ladder-like structure arranged in an end portion thereof, and further has a plurality of first contact troughs and a plurality of second contact troughs.

The first conductive contacts are received in the insulative body, and includes a pair of first differential signal contacts. Each first conductive contact has a first fixing portion, a first contacting portion connected to one end of the first fixing portion, and a first soldering portion connected to another end of the first fixing portion. The first soldering portions are received respectively in the first contact troughs.

The second conductive contacts are received in the insulative body, and include two pairs of second differential signal contacts. Each second conductive contact has a second fixing portion, a bended portion connected to one end of the second fixing portion, a second contacting portion connected to one end of the bended portion, and a second soldering portion connected to another end of the second fixing portion. The second soldering portions are received respectively in the second contact troughs.

On another embodiment of the instant disclosure, the receptacle connector further comprises a first cable set and a second cable set. The first cable set includes a pair of first signal wires, a power wire and a first ground wire. The pair of first signal wires, the power wire and the first ground wire are soldered respectively to the first soldering portions. The second wire set includes a pair of internal wire sets, where each internal wire set includes a pair of second signal wires, a second ground wire and a shielding wrap. The shielding wrap of each internal wire set sheaths the pair of second signal wires and the second ground wire. The second ground wires of the pair of internal wire sets are arranged adjacently and soldered to the same second soldering portion. The second signal wires are soldered respectively to the second soldering portions.

The assembling method of the receptacle connector includes the following steps: placing a plurality of first conductive contacts within an insulative body; placing a plurality of second conductive contacts within the insulative body; placing the insulative body, the first conductive contacts, and the second conductive contacts in a receiving space of a metallic housing; soldering a pair of first signal wires, a first ground wire, and a power wire of a first cable set to the plurality of first soldering portions; and soldering two pairs of second signal wires and a pair of second ground wires of a second cable set to the second soldering portions, where the pair of second ground wires are adjacently arranged and soldered to the same second soldering portion.

By means of the design of the ladder-like insulative body, the first soldering portions and the second soldering portions can be exposed over the insulative body toward the same direction. Therefore, the transmission wire can be soldered more easily to the insulative body. Furthermore, electromagnetic interferences can be reduced by the second cable set, formed by the second signal wires and the second ground wire, encompassed by the shielding wrap, where this also enhances the transmission of the differential signals.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Figure 1A:
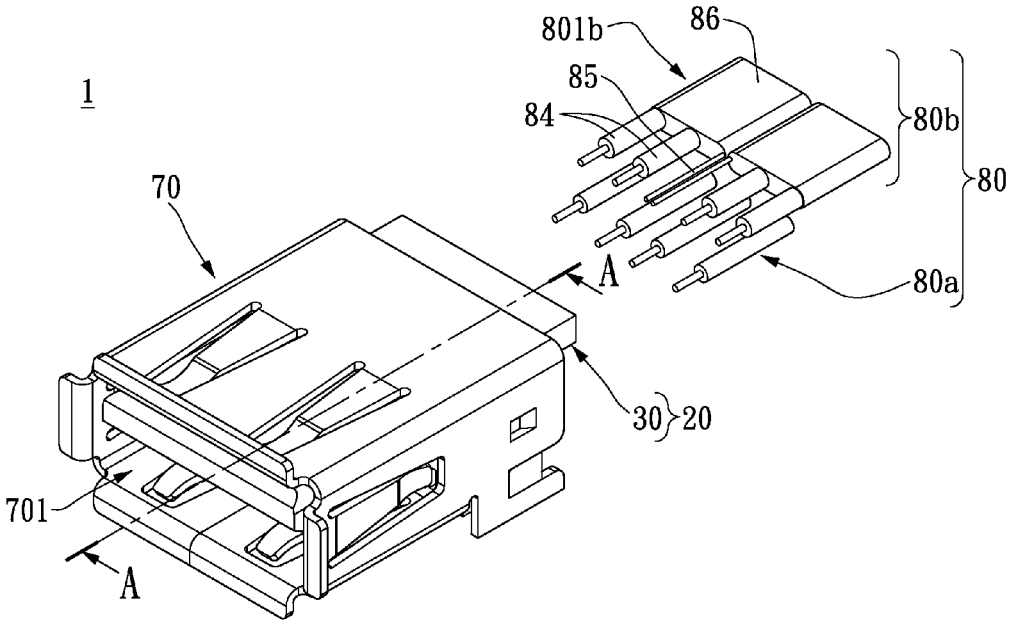
FIGS. 1A and 1B show two three-dimensional views of an receptacle connector according to the first embodiment of the instant disclosure.
Figure 1B:
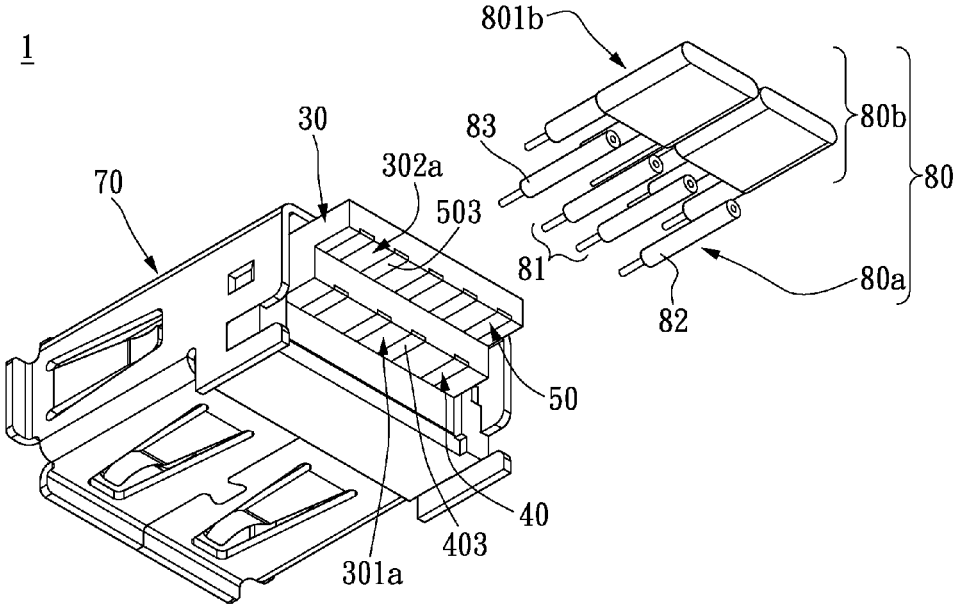
Figure 2:
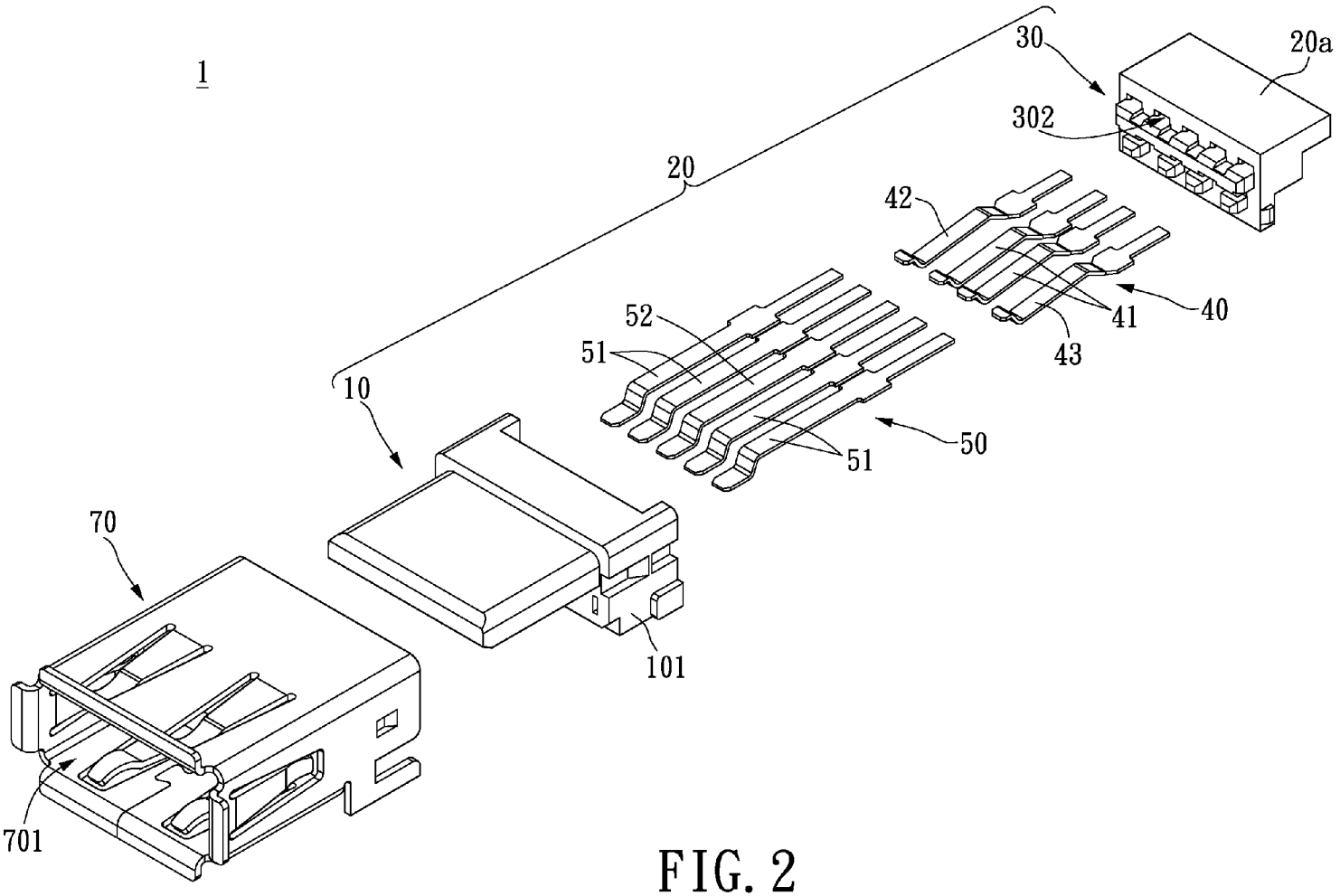
FIG. 2 shows an exploded view of the receptacle connector from FIG. 1A.

Please refer to FIGS. 1A to 2. The receptacle connector 1 of the instant embodiment includes an insulative body 20, a plurality of first conductive contacts 40 and a plurality of second conductive contacts 50. An end portion 20*a* of the insulative body 20 is a substantially ladder-like structure. Preferably, the insulative body 20 includes a tongue plate 10 and a back cap 30.

Figure 6:
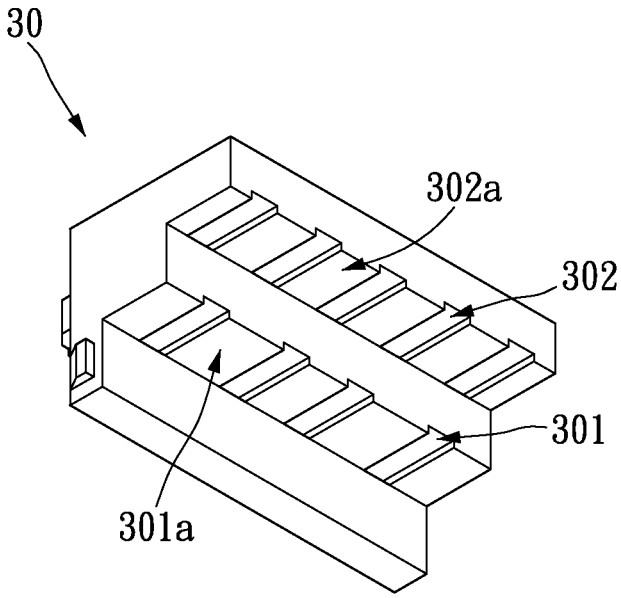
FIG. 6 shows a three-dimensional view of a back cap of the receptacle connector from FIG. 1A.

Please refer to FIG. 6. The back cap 30 has a first ladder surface 301*a* and a second ladder surface 302*a*. Therefore, the back cap 30 can be regarded as a ladder-like structure of the end portion 20*a*. The back cap 30 further has a plurality of first contact troughs 301 and a plurality of second contact troughs 302. The first contact troughs 301 and the second contact troughs 302 are concavely formed on the respective first ladder surface 301*a* and the second ladder surface 302*a*.

Figure 5:
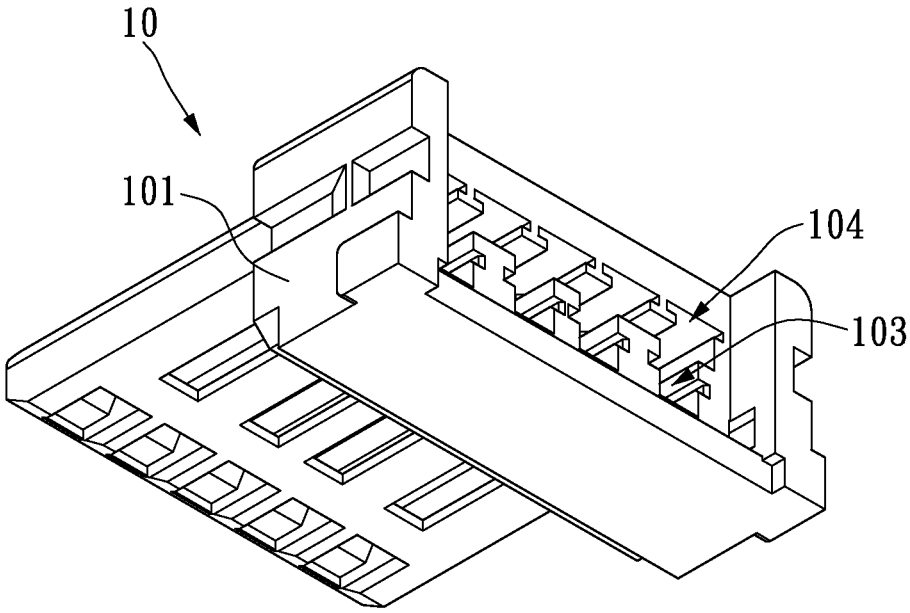
FIG. 5 shows a three-dimensional view of a tongue plate of the receptacle connector from FIG. 1A.

Please refer to FIG. 5. The tongue plate 10 has a coupling portion 101 to receive the back cap 30. The tongue plate 10 further comprises a plurality of first receiving troughs 103 and a plurality of second receiving troughs 104. The first receiving troughs 103 are in communication with the respective first contact troughs 301. The first conductive contacts 40 are received respectively in the first receiving troughs 103 and the first contact troughs 301. The second receiving troughs 104 are in communication with the respective second contact troughs 302. The second conductive contacts 50 are received respectively in the second receiving troughs 104 and the second contact troughs 302.

Figure 3:
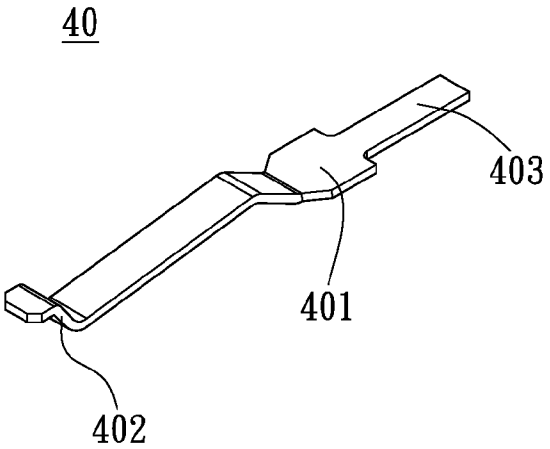
FIG. 3 shows a three-dimensional view of a first conductive contact from FIG. 2.

The first conductive contacts 40 are compatible with the USB 2.0. Shown in FIGS. 2 and 3, the first conductive contacts 40 include a pair of first differential signal contacts 41, a power contact 42 and a first ground contact 43. Each first conductive contact 40 has a first fixing portion 401, a first contacting portion 402 connected to one end of the first fixing portion 401, and a first soldering portion 403 connected to another end of the first fixing portion 401. The first contacting portion 402 is formed by bending and extending from the first fixing portion 401. The first soldering portion 403 is formed by the horizontal extension of the first fixing portion 401 which can be substantially a plate-like structure. Shown in FIG. 1B, the first soldering portions 403 are received respectively in the first contact troughs 301 of the back cap 30 and are exposed over the first ladder surface 301*a*. The first soldering portion 403 and the first ladder surface 301*a* share the same plane.

Figure 4:
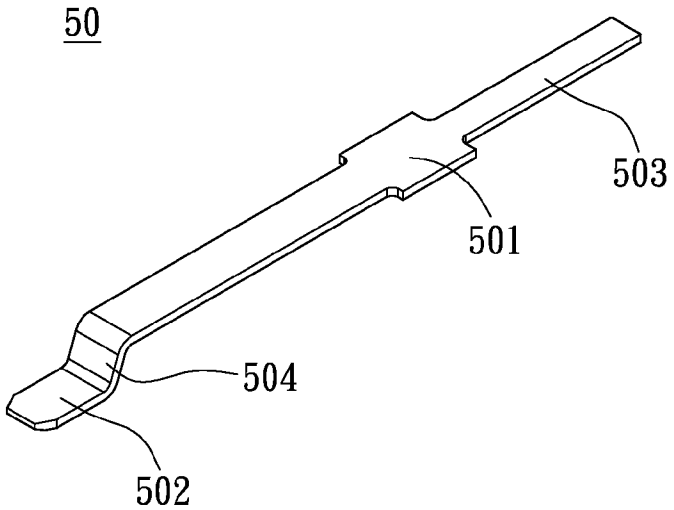
FIG. 4 shows a three-dimensional view of a second conductive contact from FIG. 2.

Both the second conductive contact 50 and the first conductive contact 40 can be compatible with USB 3.0. Shown in FIGS. 2 and 4, the second conductive contact 50 includes two pairs of second differential signal contacts 51 and a second ground contact 52. Each second conductive contact 50 has a second fixing portion 501, a bended portion 504 connected to one end of the second fixing portion 501, a second contacting portion 502 connected to one end of the bended portion 504, and a second soldering portion 503 connected to another end of the second fixing portion 501. The bended portion 504 is formed by bending and extending the second fixing portion 501. The second contacting portion 502 is formed by extending the bended portion 504. The second soldering portion 503 is formed by extending horizontally from the second fixing portion 501. Shown in FIG. 1B, the second soldering portions 503 are received respectively in the second contact troughs 302 of the back cap 30 and are exposed over the second ladder surface 302*a*. The second soldering portion 503 and the second ladder surface 302*a* shared the same plane.

Shown in FIG. 2, the receptacle connector 1 further includes a metallic housing 70. The metallic housing 70 has a receiving space 701 for receiving the insulative body 20, the first conductive contacts 40, and the second conductive contacts 50.

Figure 7:
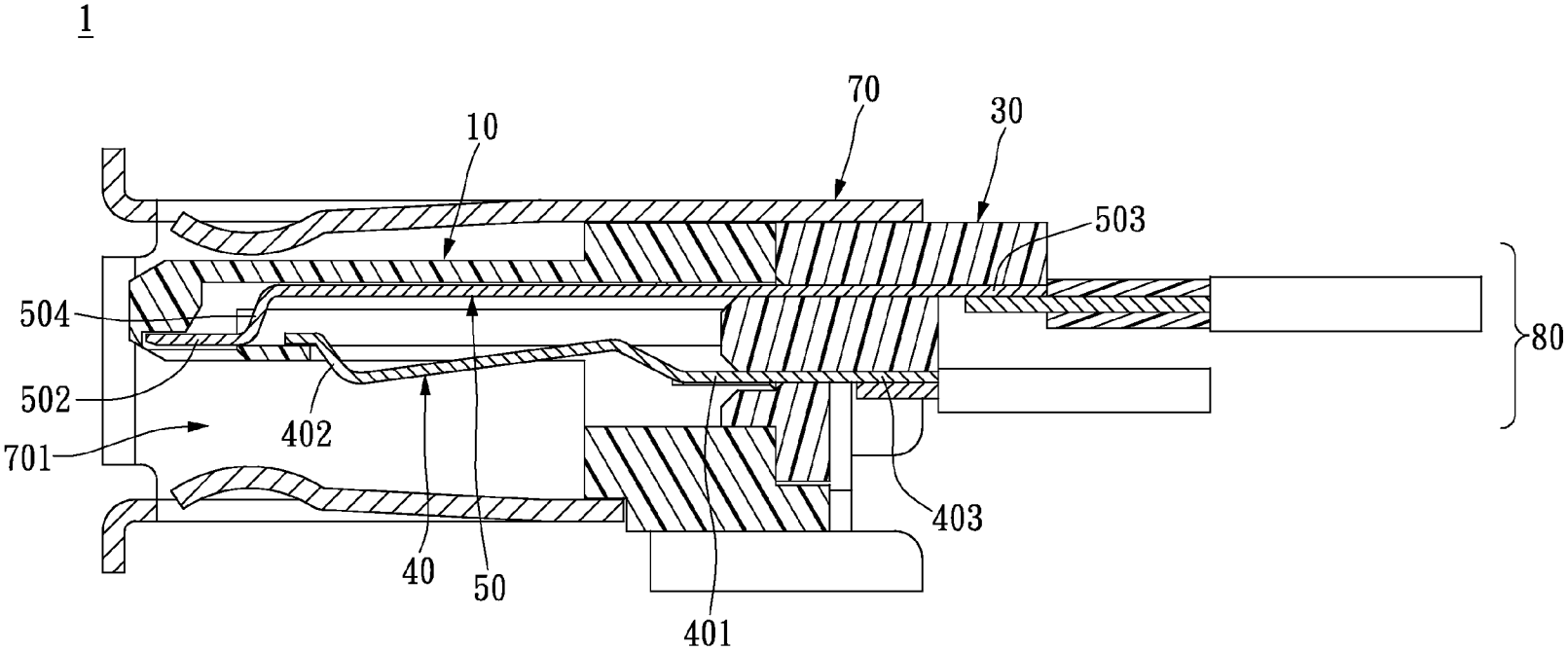
FIG. 7 shows a cross-sectional view of FIG. 1A along the AA wire direction.

Shown in FIGS. 1B and 7, the first conductive contacts 40 and the second conductive contacts 50 are disposed in the first ladder surface 301*a* and the second ladder surface 302*a* to be exposed over the back cap 30 toward the same direction. The first conductive contacts 40 and the second conductive contacts 50 can be soldered to a transmission wire 80. Since the first conductive contacts 40 and the second conductive contacts 50 are exposed over the same side of the back cap 30; therefore, when the transmission wire 80 is soldered, the first conductive contacts 40 and the second conductive contacts 50 can be soldered in a single direction and not two, and thereby simplifying the soldering process. Detail descriptions regarding the transmission wire 80 shall be provided in the following.

Shown in FIGS. 1A and 1B, the transmission wire 80 includes a first cable set 80*a* and a second cable set 80*b*. The first cable set 80*a* has a pair of first signal wires 81, a first ground wire 83, and a power wire 82. The first signal wires 81, the first ground wire 83, and the power wire 82 are soldered respectively to the first soldering portions 403. The second cable set 80*b* has a pair of internal wire set 801*b*. Each internal wire set 801*b* has a pair of second signal wire 84, a second ground wire 85, and a shielding wrap 86. The shielding wrap 86 sheaths the second signal wire 84 and the second ground wire 85. The second ground wire 85 of the internal wire set 801*b* is arranged adjacently and soldered to the same second soldering portion 503. The second signal wires 84 are soldered respectively to the second soldering portions 503.

Figure 8:
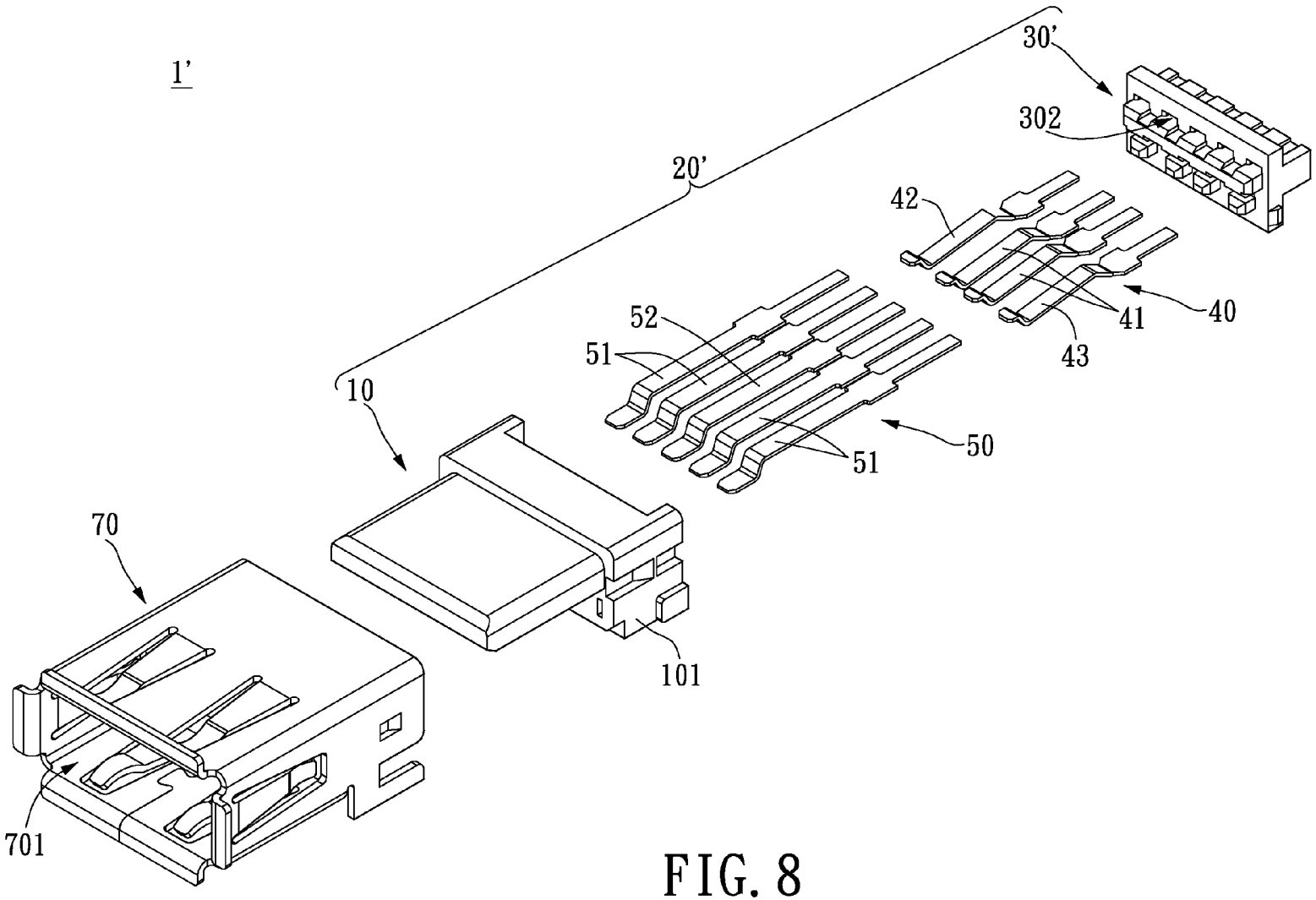
FIG. 8 shows an exploded view of a receptacle connector from another embodiment of the instant disclosure.
Figure 9:
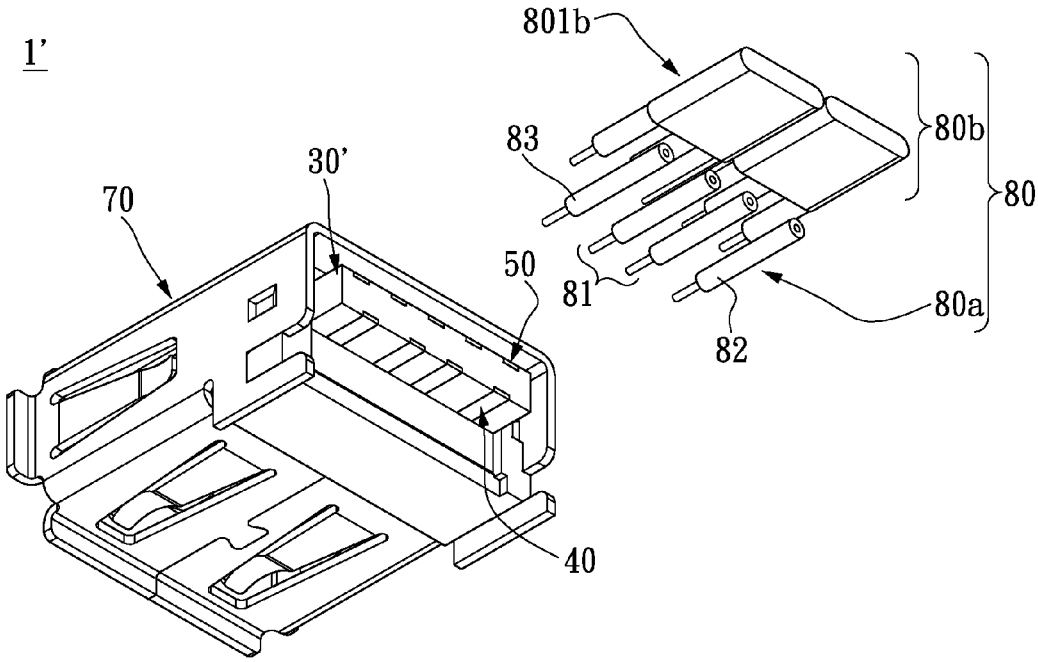
FIG. 9 shows a three-dimensional view of the receptacle connector from FIG. 8.

In another embodiment of the instant disclosure, the ladder-like back cap 30 can be replaced by a T-shaped back cap 30' as shown in FIG. 8. Shown in FIG. 9, when the T-shaped 30' is applied, the first conductive contacts 40 and the second conductive contacts 50 will be exposed toward the opposite directions over the back cap 30'. When the transmission wire 80 is soldered, the first cable set 80*a* and the second cable set 80*b* are soldered toward the opposite directions to the first soldering portions 403 and the second soldering portions 503.

Yet another embodiment of the instant disclosure, the tongue plate 10 can be integrally formed with the back cap 30 to form the insulative body 20 (not shown). The first conductive contacts 40 and the second conductive contacts 50 are arranged in the integrally formed tongue plate 10 and the back cap 30 by insert molding.

The instant disclosure also provides an assembling method of the receptacle connector 1. Firstly, placing the first conductive contacts 40 and the second conductive contacts 50 in the first receiving troughs 103 and the second receiving troughs 104 of the tongue plate 10 by means of insert molding or inserting. Next, arranging the back cap 30 in a coupling portion 101 of the tongue plate 10, so that the first soldering portions 403 and the second soldering portions 503 are exposed respectively over the first contact troughs 301 and the second contact troughs 302 of the back cap 30. It is worth noting that the sequence of arrangement of the first conductive contacts 40 and the second conductive contacts 50 is not restricted thereto.

Followed on, the insulative body 20, the first conductive contacts 40, and the second conductive contacts 50 are received in a receiving space 701 of a metallic housing 70.

Next, two first signal wires 81, a first ground wire 83, and a power wire 82 of the first cable set 80*a* are soldered to the first soldering portions 403. Then, two pairs of second signal wires 84 and two second ground wires 85 of the second cable set 80*b* are soldered to the second soldering portions 503. The pair of second ground wires 85 is arranged adjacently and soldered to the same second soldering portion 503. To provide further illustrations, the first cable set 80*a* and the second cable set 80*b* are soldered respectively to the first soldering portion 403 and the second soldering portion 503 toward the same direction. It is worth noting that if the end portion 20*a* of the insulative body 20 is a T-shaped structure instead of a ladder-like structure, and the first cable set 80*a* and the second cable set 80*b* will be soldered to the first soldering portions 403 and the second soldering portions 503 toward the opposite directions.

For the instant disclosure, the first soldering portions and the second soldering portions are exposed in the same side of the insulative body, so that the transmission wire can be soldered more easily to the first conductive contacts and the second conductive conducts so as to enhance the manufacturing efficiency. Furthermore, electromagnetic interferences can be reduced by the second cable set formed by the shielding wrap encompassing the second signal wire and the ground wire.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A receptacle connector, comprising:

an insulative body having a ladder-like structure arranged in an end portion thereof, wherein the end portion includes a plurality of first contact troughs and a plurality of second contact troughs;

a plurality of first conductive contacts received in the insulative body, wherein the first conductive contacts include a pair of first differential signal contacts, and each first conductive contact has a first fixing portion, a first contacting portion connected to one end of the first fixing portion, and a first soldering portion connected to another end of the first fixing portion, and the first soldering portions are received in the first contact troughs; and a plurality of second conductive contacts received in the insulative body, wherein the second conductive contacts include two pairs of second differential signal contacts, wherein each second conductive contact includes a second fixing portion, a bended portion connected to one end of the second fixing portion, a second contacting portion connected to one end of the bended portion, and a second soldering portion connected to another end of the second fixing portion, and the second soldering portions are received in the second receiving troughs;

wherein the first soldering portions and the second soldering portions are exposed respectively over the first contact troughs and the second contact troughs of the insulative body toward the same direction.

2. The receptacle connector according to claim 1, wherein the insulative body includes a tongue plate and a back cap, wherein the tongue plate has a coupling portion to receive the back cap, and a plurality of first receiving troughs and a plurality of second receiving troughs, wherein the first contact troughs and the second contact troughs are formed in the back cap.

3. The receptacle connector according to claim 2, wherein the first receiving troughs are in communication with the first contact troughs to receive the first conductive contacts, and the second receiving troughs are in communication with the second contact troughs to receive the second conductive contacts.

4. The receptacle connector according to claim 2, wherein the back cap has a first ladder surface and a second ladder surface, wherein the first contact troughs are concavely formed on the first ladder surface, and the second contact troughs are concavely formed on the second ladder surface.

5. The receptacle connector according to claim 4, wherein the first soldering portions of the first conductive contacts shares the same plane with the first ladder surface, and the second soldering portions of the second conductive contacts shares the same plane with the second ladder surface.

6. The receptacle connector according to claim 1, wherein the first contacting portion is bent and extends from one end of the first fixing portion, and the first soldering portions extend horizontally from another end of the first fixing portion.

7. The receptacle connector according to claim 1, wherein the bended portion is bent and extends from one end of the second fixing portion, the second contacting portion extends from one end of the bended portion, the second soldering portions extend horizontally from another end of the second fixing portion.

8. The receptacle connector according to claim 1, further comprising a metallic housing, wherein the metallic housing has a receiving space, and the insulative body, the first conductive contacts, and the second conductive contacts are received in the receiving space.

9. The receptacle connector according to claim 1, further comprising a first cable set and a second cable set, wherein the first cable set includes a pair of first signal wires, a first ground wire, and a power wire, wherein the pair of first signal wires, the first ground wire, and the power wire are soldered respectively to the first soldering portions, the second cable set includes a pair of internal wire sets having a pair of second signal wires, a second ground wire, and a shielding wrap, wherein the shielding wrap of each internal wire set sheaths the second signal wire and the second ground wire, the second ground wires are arranged adjacently and are soldered to the same second soldering portion, and wherein the second signal wires are soldered respectively to the second soldering portions.

10. A receptacle connector, comprising:

an insulative body having a plurality of first contact troughs and a plurality of second contact troughs;

a plurality of first conductive contacts received in the insulative body, wherein the first conductive contacts include a pair of first differential signal contacts, and each first conductive contact has a first fixing portion, a first contacting portion connected to one end of the first fixing portion, and a first soldering portion connected to another end of the first fixing portion, wherein the first soldering portions are received in the first contact troughs; and a plurality of second conductive contacts received in the insulative body, wherein the second conductive contacts include two pairs of second differential signal contacts, wherein each second conductive contact includes a second fixing portion, a bended portion connected to one end of the second fixing portion, a second contacting portion connected one end of the bended portion, and a second soldering portion connected to another end of the second fixing portion, and wherein the second soldering portions are received in the second receiving troughs;

a first cable set having a pair of first signal wires, a first ground wire, and a power wire, wherein the pair of first signal wires, the first ground wire, and the power wire are soldered respectively to the first soldering portions a second cable set having a pair of internal wire sets, wherein each internal wire set has a pair of second signal wires, a second ground wire, and a shielding wrap, wherein the shielding wrap of each internal wire set sheaths the pair of second signal wires and the second ground wire, and wherein the second ground wire is arranged adjacently and soldered to the same second soldering portions, wherein the second signal wires are soldered respectively to the second soldering portions;

wherein the first soldering portions and the second soldering portions are exposed over the first contacts troughs and the second contacts troughs of the insulative body toward the opposite directions.

11. The receptacle connector according to claim 10, wherein the insulative body includes a tongue plate and a back cap, wherein the tongue plate has a coupling portion to receive the back cap, the tongue plate has a plurality of first receiving troughs and a plurality of second receiving troughs, wherein the first contact troughs and the second contact troughs are formed in the back cap.

12. The receptacle connector according to claim 11, wherein the first receiving troughs are in communication with the first contact troughs to receive the first conductive contacts, and wherein the second receiving troughs are in communication with the second contact troughs to receive the second conductive contacts.

13. The receptacle connector according to claim 11, wherein the back cap has a first ladder surface and a second ladder surface, wherein the first contact troughs are concavely formed on the first ladder surface, and the second contact troughs are concavely formed on the second ladder surface.

14. The receptacle connector according to claim 13, wherein the first soldering portions of the first conductive contacts share the same plane with the first ladder surface, and wherein the second soldering portions of the second conductive contacts share the same plane with the second ladder surface.

15. The receptacle connector according to claim 10, further comprising a metallic housing, wherein the metallic housing has a receiving space, wherein the insulative body, the first conductive contacts, and the second conductive contacts are received in the receiving space.

16. The receptacle connector according to claim 10, wherein the first soldering portions are flat.

17. An assembling method of a receptacle connector, comprising the following steps of:

placing a plurality of first conductive contacts in an insulative body, wherein the first conductive contacts include a pair of first differential signal contacts, wherein each first conductive contact includes a first fixing portion, a first contacting portion connected to one end of the first fixing portion, and a first soldering portion connected to another end of the first fixing portion;

placing a plurality of second conductive contacts in the insulative body, wherein the second conductive contacts include two pairs of second differential signal contacts, wherein each second conductive contact includes a second fixing portion, a bended portion connected to one end of the fixing portion, a second contacting portion connected to one end of the bended portion, and a second soldering portion connected to another end of the second fixing portion;

placing the insulative body, the first conductive contacts, and the second conductive contacts in a receiving space of a metallic housing;

soldering a pair of signal wires, a first ground wire, and a power wire of a first cable set to the first soldering portions; and soldering two pairs of second signal wires and a pair of second ground wires of a second cable set to the second soldering portions, wherein the pair of second ground wire is arranged adjacently and soldered to the same second soldering portion.

18. The assembling method of a receptacle connector according to claim 17, wherein the insulative body includes a tongue plate and a back cap, wherein after the first conductive contacts and the second conductive contacts are arranged on the tongue plate, the back cap is arranged in an end portion of the tongue plate, the first soldering portions and the second soldering portions are exposed respectively over the first contact troughs and the second contact troughs of the back cap.

19. The assembling method of a receptacle connector according to claim 17, wherein the first cable set and the second cable set are soldered to the first soldering portions and the second soldering portions toward the same direction.

20. The assembling method of a receptacle connector according to claim 17, wherein the first cable set and the second cable set are soldered to the first soldering portions and the second soldering portions toward the opposite directions.

* * * * *